US008684012B1

(12) United States Patent
Ryan

(10) Patent No.: US 8,684,012 B1
(45) Date of Patent: Apr. 1, 2014

(54) REMOTE CONTROL ROLLERS

(76) Inventor: Denise Lynn Ryan, Flagstaff, AZ (US)

( * ) Notice: Subject to any disclaimer, the term of this patent is extended or adjusted under 35 U.S.C. 154(b) by 0 days.

(21) Appl. No.: 13/484,283

(22) Filed: May 31, 2012

(51) Int. Cl.

| | |
|---|---|
| ***A45D 1/02*** | (2006.01) |
| ***A45D 2/22*** | (2006.01) |
| ***A45D 2/00*** | (2006.01) |
| ***A45D 2/14*** | (2006.01) |
| ***A45D 1/04*** | (2006.01) |
| ***A45D 2/36*** | (2006.01) |
| ***A45D 4/00*** | (2006.01) |

(52) U.S. Cl.
USPC ..... 132/227; 132/229; 132/245

(58) Field of Classification Search
USPC ..... 132/227, 200, 286, 207, 210, 211, 254, 132/212, 217, 222, 223, 226, 228, 229, 236, 132/237, 245–252, 269, 271, 333; 34/96, 34/283, 99, 101; 219/222, 223, 225, 226, 219/227, 228, 229; 392/379, 380, 383, 384
See application file for complete search history.

(56) References Cited

U.S. PATENT DOCUMENTS

| | | | | | |
|---|---|---|---|---|---|
| 1,377,655 | A * | 5/1921 | Begas | 132/229 |
| 3,347,248 | A * | 10/1967 | Weitzner | 132/252 |
| 3,476,121 | A * | 11/1969 | Foley | 132/229 |
| 3,523,542 | A * | 8/1970 | Eisler | 132/229 |
| 3,560,703 | A * | 2/1971 | Chedister | 219/222 |
| 3,603,765 | A * | 9/1971 | Underwood | 219/222 |
| 3,658,071 | A * | 4/1972 | Wise | 132/233 |
| 3,701,882 | A * | 10/1972 | Wada et al. | 219/222 |
| 3,727,321 | A * | 4/1973 | Waters et al. | 34/99 |
| 3,901,250 | A * | 8/1975 | Tomiati | 132/229 |
| 3,908,673 | A * | 9/1975 | Carr | 132/223 |
| 4,124,034 | A * | 11/1978 | Meyerhoefer et al. | 132/212 |
| 4,447,705 | A * | 5/1984 | Bullock | 219/222 |
| 4,499,355 | A * | 2/1985 | Walter | 219/618 |
| 4,533,818 | A * | 8/1985 | Green | 219/222 |
| 4,627,452 | A * | 12/1986 | Caruso | 132/229 |
| 4,641,010 | A * | 2/1987 | Abura et al. | 219/222 |
| 4,647,755 | A * | 3/1987 | Mack | 219/222 |
| 4,958,648 | A * | 9/1990 | Morey | 132/220 |
| 5,117,090 | A * | 5/1992 | Askins | 219/222 |
| 5,640,781 | A * | 6/1997 | Carson | 34/97 |
| 5,651,190 | A * | 7/1997 | Sanders | 34/99 |
| 5,862,813 | A * | 1/1999 | Bugane | 132/252 |
| 6,114,661 | A * | 9/2000 | Leung | 219/222 |
| 6,310,322 | B1 * | 10/2001 | Yang et al. | 219/386 |
| 6,881,928 | B2 * | 4/2005 | Wong et al. | 219/222 |
| 6,964,116 | B2 * | 11/2005 | Kroll et al. | 34/96 |
| 7,096,597 | B1 * | 8/2006 | Zellous | 34/90 |
| 7,123,823 | B2 * | 10/2006 | Ceva | 392/385 |
| 7,516,745 | B2 * | 4/2009 | Maione et al. | 132/231 |

(Continued)

*Primary Examiner* — Vanitha Elgart
(74) *Attorney, Agent, or Firm* — Invention To Patent Services; Alex R Hobson

(57) ABSTRACT

A hair roller system that comprises a hair roller having a heating element, a battery, and a signal receiver is described. In one embodiment, the hair roller system also comprises a signal output device that allows a user to activate a hair roller to heat after being placed in their hair. Activating a heating element in a hair roller after it is placed in a person's hair avoids burns and discomfort from handling excessively hot rollers. In some embodiments, a hair roller may comprise an on/off switch, a temperature set point feature, and/or a heat duration set point feature.

19 Claims, 9 Drawing Sheets

(56) References Cited

U.S. PATENT DOCUMENTS

| | | | | |
|---|---|---|---|---|
| 2004/0127822 | A1* | 7/2004 | Eisenberg | 601/49 |
| 2006/0205381 | A1* | 9/2006 | Beart et al. | 455/343.1 |
| 2007/0283978 | A1* | 12/2007 | Montagnino | 132/211 |
| 2008/0210255 | A1* | 9/2008 | Moll | 132/223 |
| 2010/0031970 | A1* | 2/2010 | Klovstad | 132/211 |
| 2010/0116286 | A1* | 5/2010 | O'Rourke | 132/254 |
| 2012/0037179 | A1* | 2/2012 | Zimmerman | 132/211 |
| 2012/0233866 | A1* | 9/2012 | Kammer | 30/201 |

* cited by examiner

REMOTE CONTROL ROLLERS

FIELD OF THE INVENTION

The present invention relates to hair rollers and particularly to a hair roller system wherein a hair roller comprises a heating element that may be activated by a signal output device.

BACKGROUND

Currently, hair rollers are heated and subsequently placed into a person's hair for a period of time to set the hair with curls or waves. Manipulating heated rollers is uncomfortable and in some cases can result in burns. In addition, as the heated rollers are placed into the hair, they quickly cool and become less effective. Furthermore, for uniform curls or waves, it is important to leave each of the rollers in place for approximately the same amount of time. When placing a large number of heated rollers in a person's hair, it may be difficult to time the placement and removal to provide an approximate equal heating duration for all rollers.

SUMMARY OF THE INVENTION

The invention is directed to hair roller systems that comprise a hair roller having a heating element, a battery, and a signal receiver. The hair roller system may further comprise a signal output device that allows a user to activate a roller to heat after being placed in their hair, thereby avoiding burns and discomfort from handling excessively hot rollers. In some embodiments, a hair roller may comprise an on/off switch, a temperature set point feature, or a heat duration set point feature as described herein.

Any quantity of rollers may be part of the hair roller system as described herein including, but not limited to, more than one, more than two, more than five, more than ten, more than fifteen, more than twenty, and any range between and including the quantities provided. In addition, rollers may be of different sizes and/or shapes, therein providing for different amounts of curl. Any type of roller may be used, including rollers having protrusions to capture the hair, rollers having hair retainers to capture the hair, rollers with a tacky material for capturing the hair, separate hair capture clips, and the like.

In an exemplary embodiment, a hair roller, as described herein, comprises a heating element that may be activated by a signal output device after the rollers are placed in a person's hair. The heating element may comprise a resistive element, such as wire or metal film, and the like. The heating element may be an integral part of the roller, or may be configured to be detached from the roller. For example, the hair roller may comprise a hair capture portion and a heating element that may be detached from the hair capture portion. In an exemplary embodiment, the hair capture portion is a cylinder and the heating element is configured within the inner volume of the cylinder. In addition, a battery may be configured within the inner volume of the hair capture portion to provide current to heat the heating element. Any suitable type of battery may be used including, but not limited to, alkaline, zinc, lithium ion, and the like. The battery and heating element may be configured in any suitable manner. The battery and heating element may be configured within the hair capture portion, or may be part of the hair capture portion. In an exemplary embodiment, a heating element may comprise retainers or clips used to retain hair on the outer surface of the hair roller. In another embodiment, a heating element comprises a metal film that covers at least a portion of the outer surface of the hair roller. In yet another embodiment, a heating element comprises protrusions that extend from the surface of a hair roller. Protrusions may be discrete or may be contiguous, such as a protrusion that spirals around the outside of the hair roller.

A hair roller may comprise a controller, such as a microprocessor, for controlling the functions of the hair roller. For example, the controller may control when the heating element is activated, the duration of a heating cycle the temperature of the roller, and any other functions associated with the hair roller as described herein. The controller may receive input from user set points, such as temperature and duration, may receive input from sensors, such as temperature for example, and may receive signals from a signal output device. The controller may use these inputs to control the function of the roller.

A hair roller may comprise a sound feature that may be activated for any suitable reason, such as when the heating duration time has elapsed, when the roller has become too hot, or too cold, when the roller has been left in the on position for too long, or any other suitable reason. A roller controller may control when the sound feature is activated.

A hair roller system, as described herein, comprises a signal output device that may be used to activate the heating element of a hair roller. A signal output device comprises a user operative switch that, when activated sends a wireless signal to at least one hair roller, whereby the signal is received by a signal receiver on the hair roller. The hair roller heating element may then be activated to turn on. A signal output device may be configured in any suitable manner, such as a key fob, or other handheld device. In an exemplary embodiment, a signal output device is configured on a hair roller container, wherein a plurality of hair rollers may be stored. The signal output device may comprise a number of other control set point features, such as a temperature set point, a heating duration set point, and an on/off switch. In addition, a signal output device may further comprise a sound feature for the purposes previously described herein.

A roller container may be configured to hold any suitable number of hair rollers. In addition, a roller container may further comprise a cover, wherein the hair rollers may be securely retained within the container. In one embodiment, a roller container comprises a spindle, whereby a roller may be placed thereon. A roller container may also comprise a heating element to preheat rollers. The heating element may be configured to heat an individual roller, or may be configured around a plurality of rollers. The roller container heating element may only heat rollers that are turned on, or placed in the container, thereby reducing energy useage. A roller container may comprise any suitable power supply, such as battery power or plug-in power.

The hair roller system described herein may be used in any suitable manner. For example, a hair roller system comprising a plurality of hair rollers having heating elements and signal receivers may be placed in a person's hair. A signal output device may then be activated, to send a wireless signal that is received by the signal receivers. When a hair roller signal receiver receive the wireless signal, a heating element in the hair roller is activated. After a duration of time has passed, the signal output device may be activated to turned off or deactivate the hair roller heating element. In one embodiment, the hair roller system, as described herein, comprises a repeat feature that allows a user to activate the hair rollers to repeat a heating cycle.

In another embodiment, a hair roller system comprises a plurality of hair rollers, and a hair roller container. A user may turn on selected quantity of the hair roller within the roller container. The user may then turn on a roller container heating element that may then heat only the rollers that have been turned on. The hair roller container may comprise a sound feature, that when activated may alert the user that the hair rollers have reached a preheat temperature. The user may then place the rollers in their hair and activate the signal output device to activate the heating elements within the rollers. The heating element within the rollers would increase the temperature of the rollers to a temperature set on the signal output device temperature set point feature. After a preset heat duration set point time has passed, as set on a signal output device heat duration set point feature, a sound may be activated to alert the user that it is time to remove the rollers. A signal output device controller may automatically send a wireless signal that deactivates the heating elements on the hair rollers after the heat duration time has passed.

The summary of the invention is provided as a general introduction to some of the embodiments of the invention, and is not intended to be limiting. Additional example embodiments, including variations and alternative configurations of the invention, are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
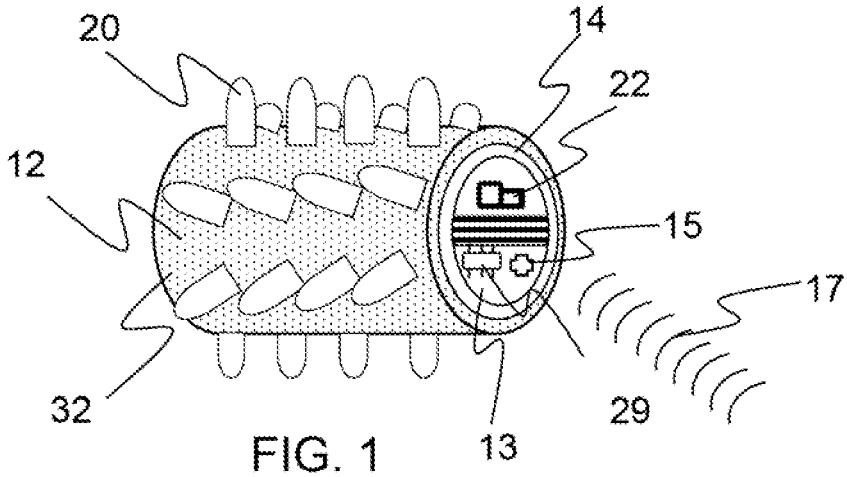

FIG. 1 shows an isometric view of an exemplary hair roller having protrusions.

Figure 2:
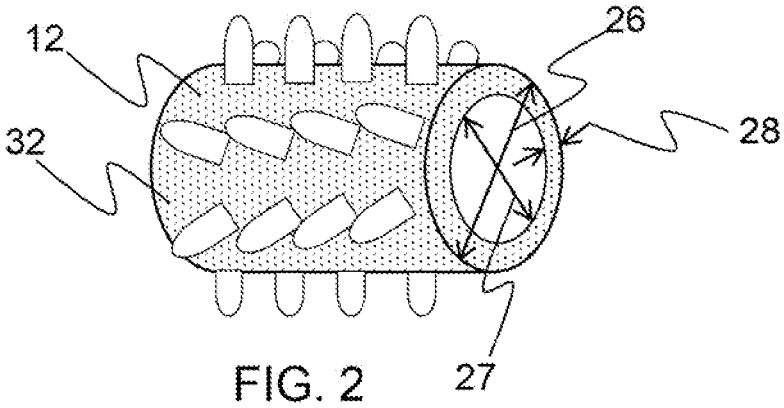

FIG. 2 shows an isometric view of an exemplary hair roller capture portion.

Figure 3A:
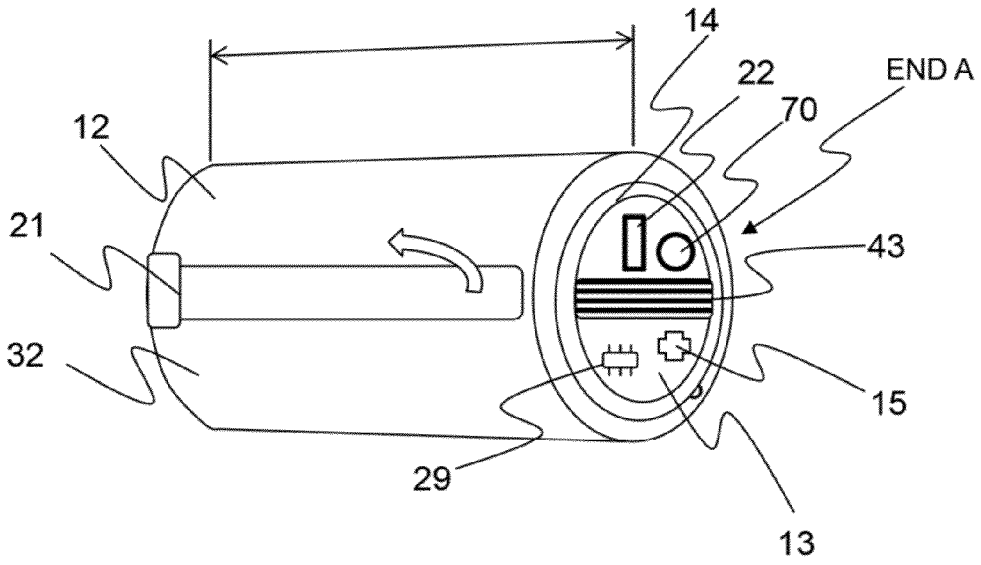

FIG. 3A shows an isometric view of an exemplary hair roller having a hair retainer with end A shown.

Figure 3B:
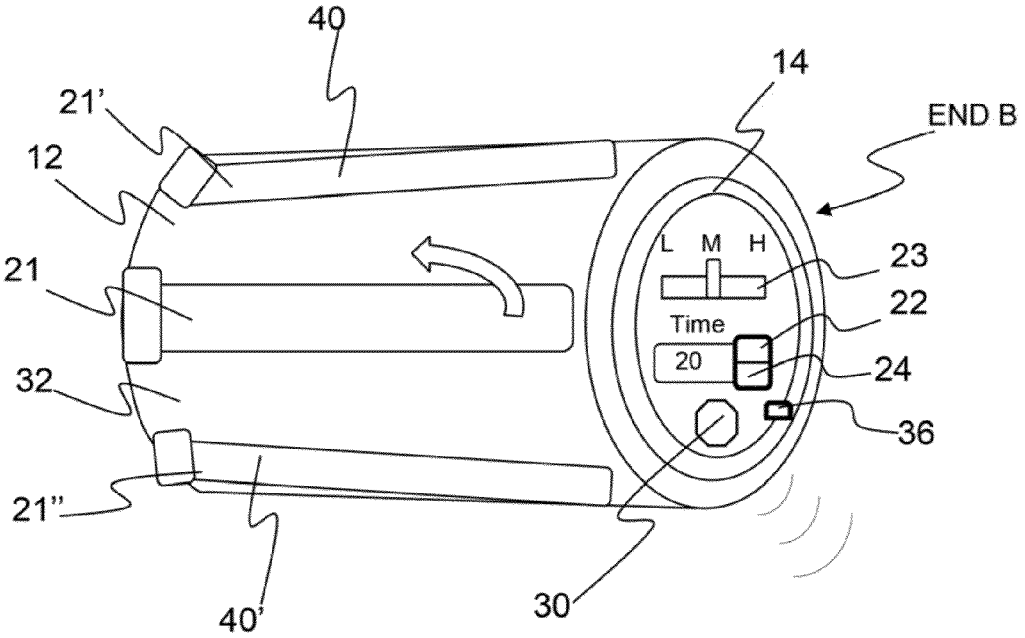

FIG. 3B shows an isometric view of the exemplary hair roller shown in FIG. 3A with end B shown.

Figure 4:
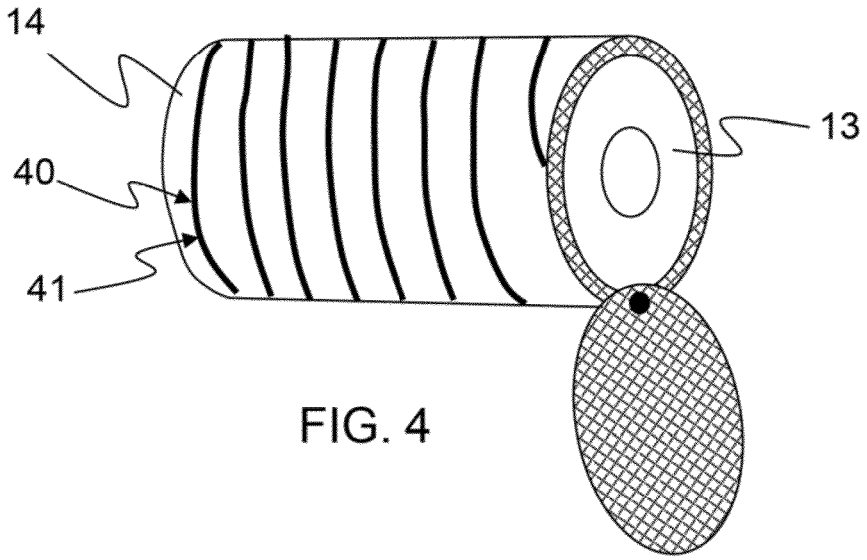

FIG. 4 shows an isometric view of an exemplary hair roller heating element, having a battery configured therein.

Figure 5:
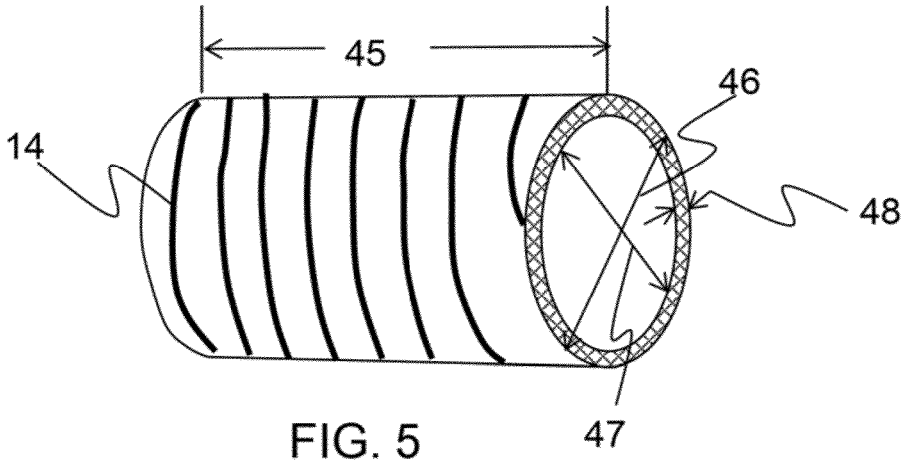

FIG. 5 shows an isometric view of an exemplary hair roller heating element.

Figure 6:
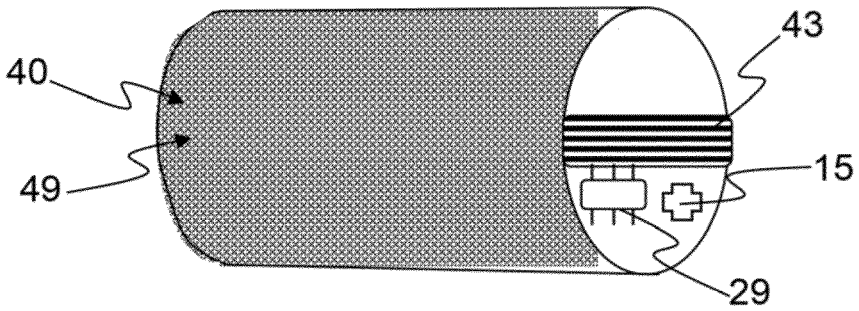

FIG. 6 shows an isometric view of an exemplary hair roller heating element.

Figure 7:
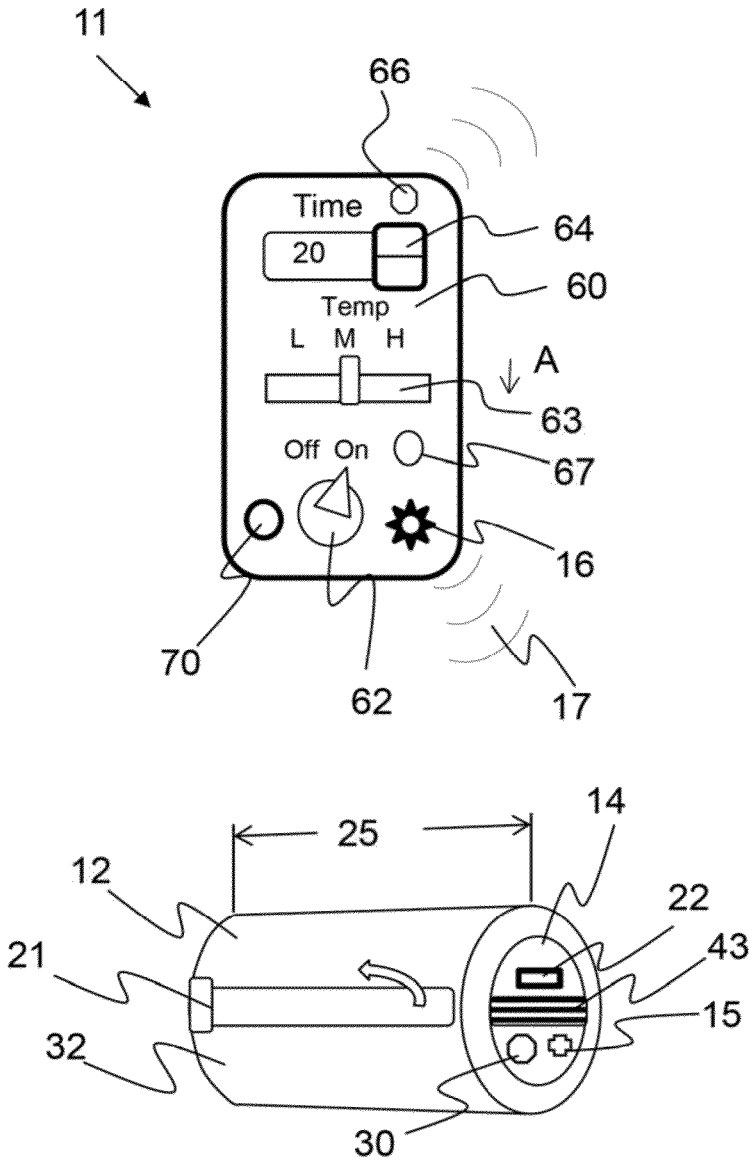
Figure 8:
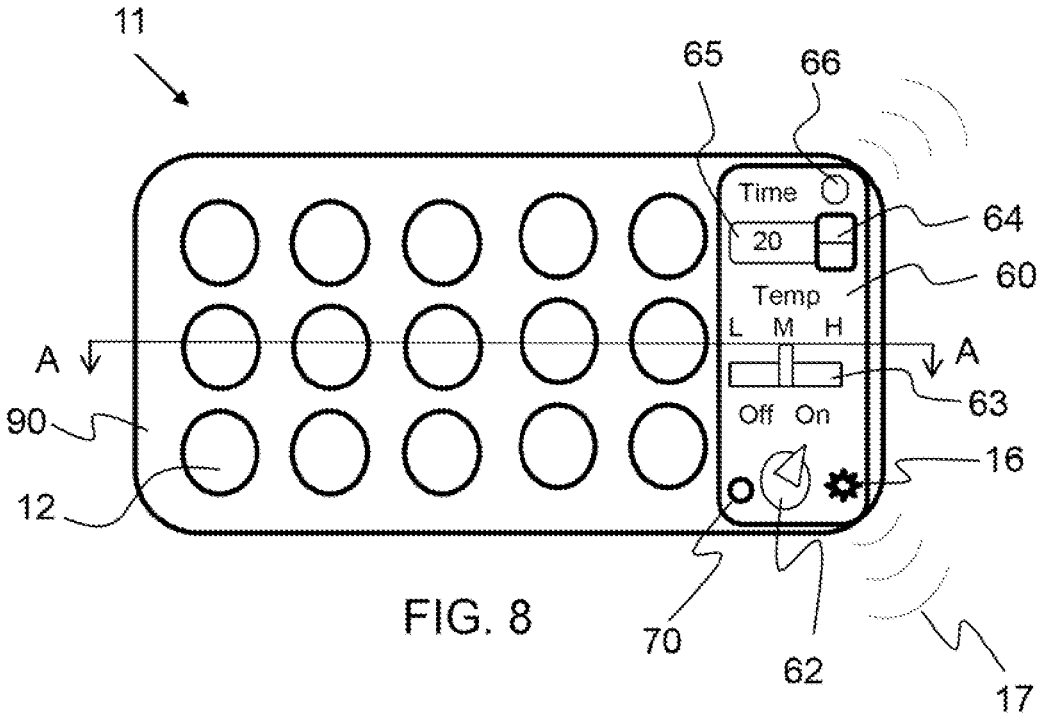

FIG. 7 shows an isometric view of a hair roller system comprising a controller having a signal output device and a hair roller having a signal receiver:

FIG. 8 shows a top down view of an exemplary hair roller system comprising a hair roller container with an attached controller.

Figure 9:
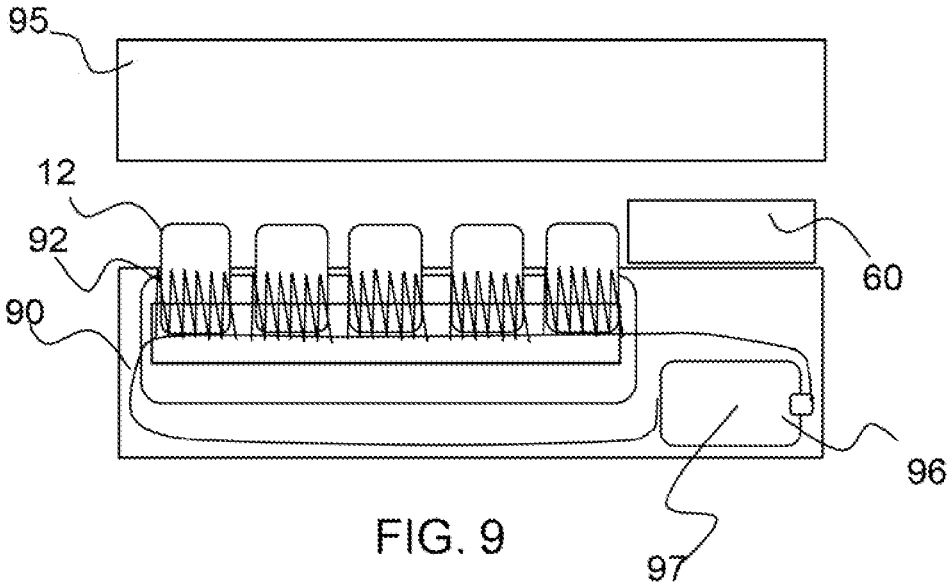

FIG. 9 shows a cut away view along line A of the exemplary hair roller system shown in FIG. 8.

Figure 10:
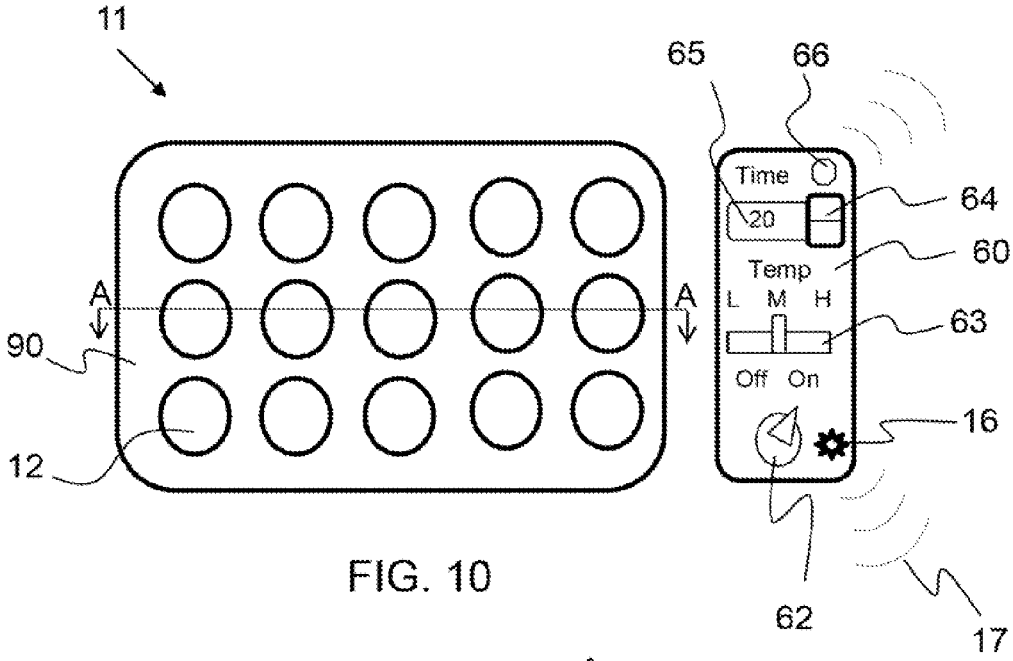

FIG. 10 shows a top down view of an exemplary hair roller system comprising a hair roller container with a detached controller.

Figure 11:
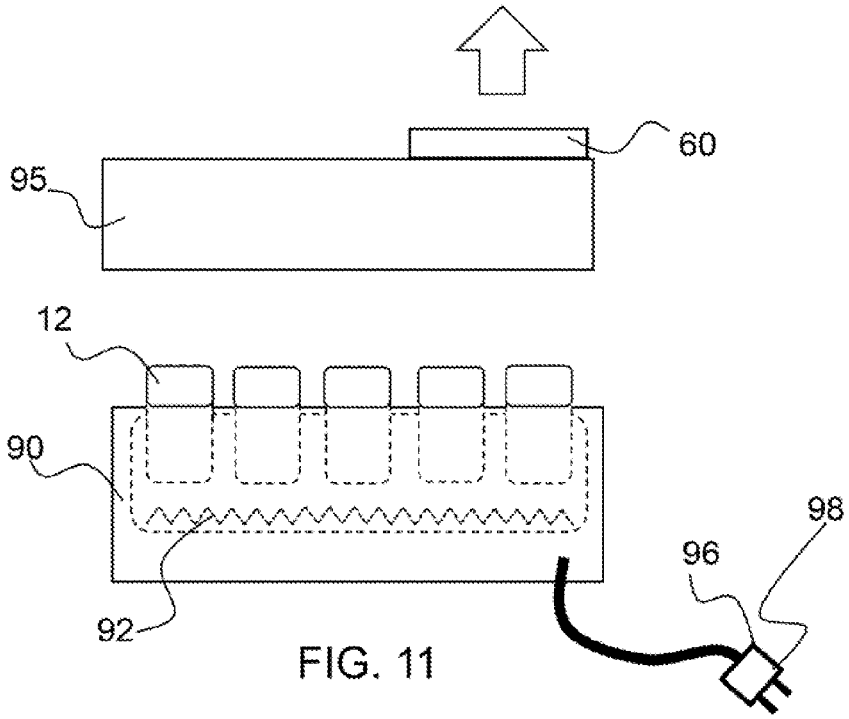

FIG. 11 shows a cut away view along line A of the exemplary hair roller container and cover shown in FIG. 10.

Figure 12A:
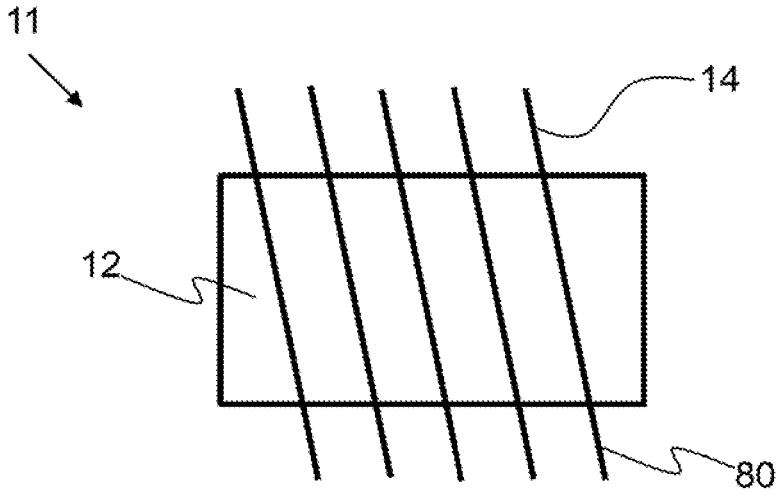

FIG. 12A shows a side view of an exemplary hair roller having a spirally wound protrusion type heating element.

Figure 12B:
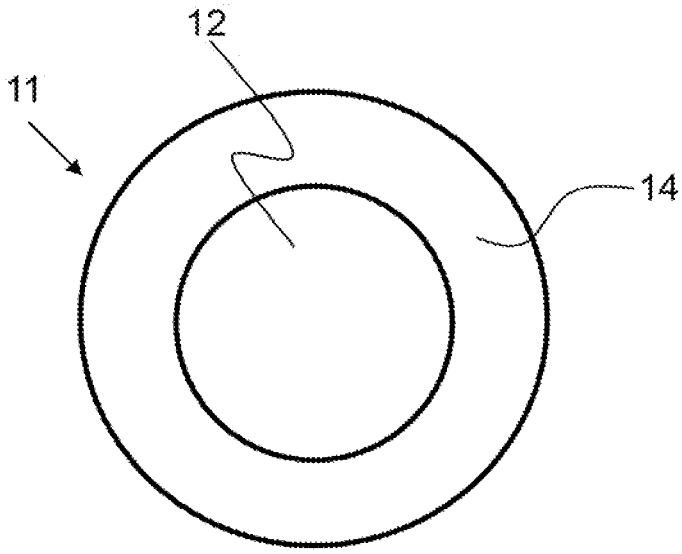

FIG. 12B shows an end view of the exemplary hair roller shown in FIG. 12B.

Figure 13A:
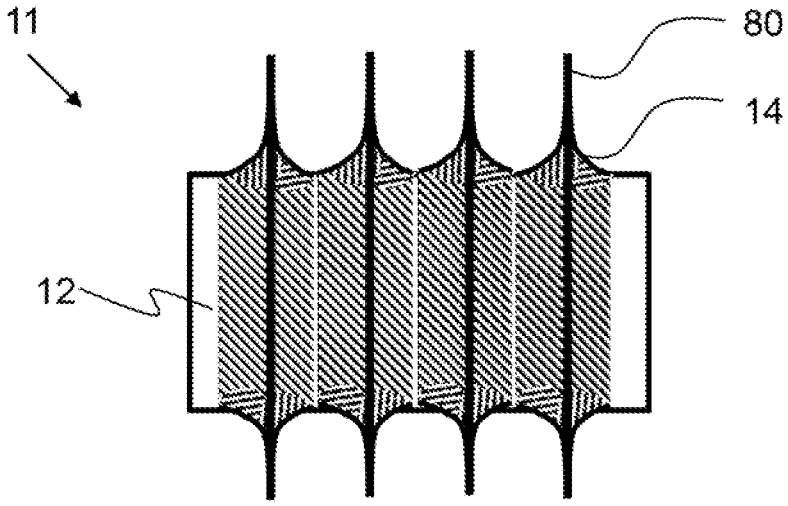

FIG. 13A shows a side view of an exemplary hair roller having a protrusion type heating element.

Figure 13B:
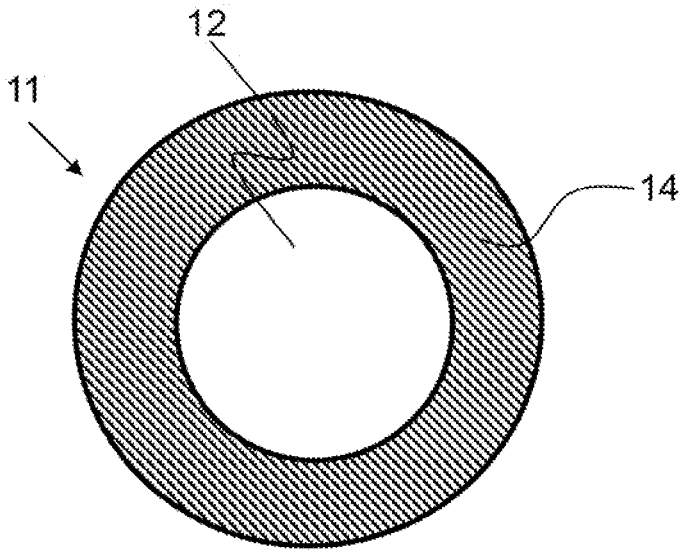

FIG. 13B shows an end view of an exemplary hair roller shown in FIG. 13A.

Figure 14A:
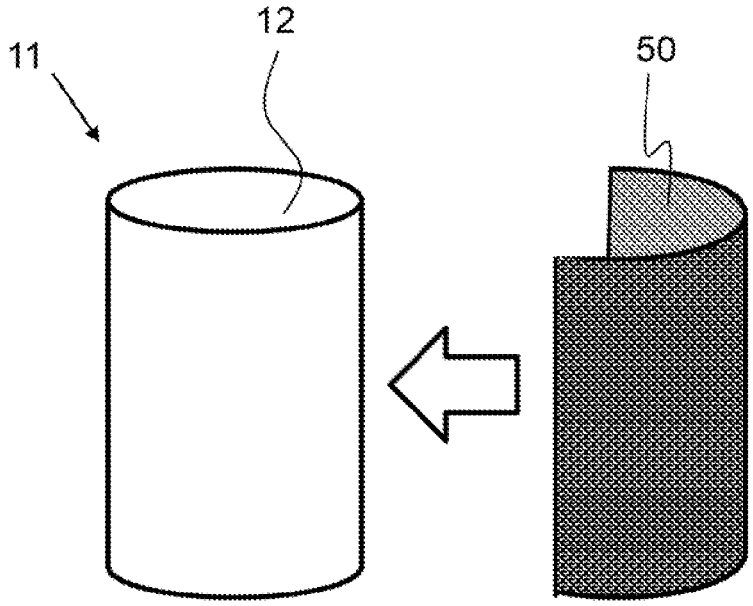

FIG. 14A shows an isometric view of a hair roller and a separate hair retainer clip.

Figure 14B:
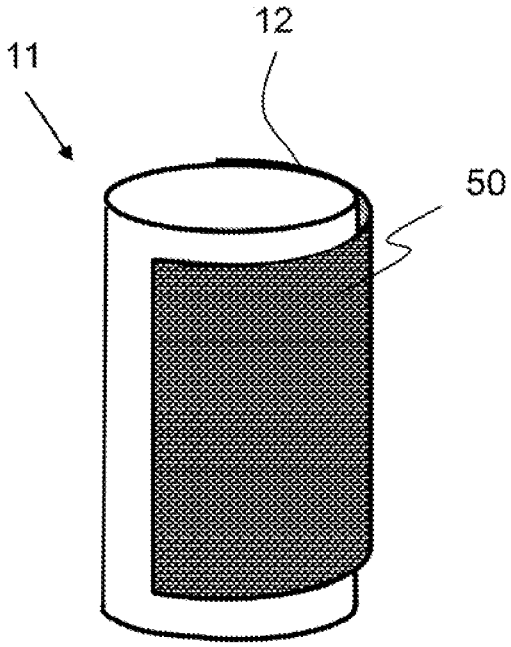

FIG. 14B shows an isometric view of a hair roller with a hair capture clip attached to the hair roller.

Figure 14C:
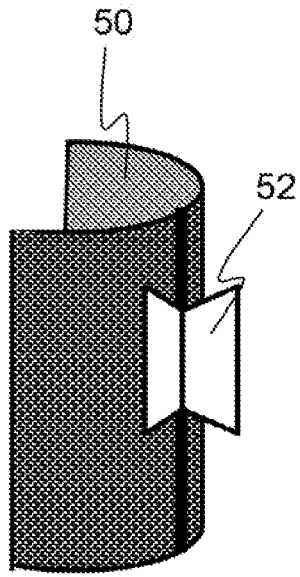

FIG. 14C shows an isometric view of a hair retainer clip.

The figures referred to above are not drawn necessarily to scale and should be understood to present a representation of the invention, illustrating the principles involved. The same reference numbers are used in the drawings for similar or identical components and features shown in various alternative embodiments.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for the purpose of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, and improvements are within the scope of the present invention.

FIG. 1 and FIG. 3A show exemplary hair rollers of the present invention. FIG. 1 shows a hair roller 12 having protrusions 20 that may be used to catch hair when winding the roller in a person's hair. FIG. 3A shows an exemplary hair roller 12 having a hair retainer 21, configured as an attached Clip, for capturing hair during rolling. Any number and configurations of hair retainers or protrusions may be configured on a hair roller. For example, one, two, three, four or more clips may be configured on a hair roller.

A hair roller, as described herein, and shown in FIGS. 1 and 3A comprises a heating element 14, a battery 13, and a signal receiver 15. The heating element 14 of a hair roller may be activated to heat, thereby drawing electrical current from the battery 13 when a wireless signal is received by the signal receiver 15. A hair roller may comprise a hair roller controller 29, such as a microprocessor for activating the heating element. A controller 29 may control any number of operations and functions of the hair roller. For example, the controller may receive input from the signal receiver, a temperature set point feature, a heat duration feature, a temperature sensor and the like. A controller may use these inputs to control the activation and deactivation of a heating element, a sound feature, a light feature and the like.

A hair roller may be configured in any suitable shape and size, such as cylindrical or rod shaped, or may have a rectangular, square or oval cross section. A heating element 14 may be configured on the hair roller in any suitable manner. In an exemplary embodiment, a heating element is configured within a hair capture portion 32 of a hair roller, as shown in FIG. 1 and FIG. 3A, where the heating element is configured between a battery and a hair capture portion. An exemplary hair roller capture portion, as shown in FIG. 2 may be a cylinder having an outer diameter 26, an inner diameter 27 and wall thickness 28. A heating element as well as a battery may be concentrically configured within the hair capture portion 32, as shown in FIG. 1 and FIG. 3A. A detachable hair roller portion may provide for easy cleaning and storage. A detached hair roller portion, which may compromise electronic elements if used on a hair roller having the heating element attached, may be cleaned in any suitable way including using liquids.

A hair roller of the present invention may further comprise an on-off switch 22, as shown in FIG. 1 and FIG. 3A, thereby allowing for heating of only selected hair rollers. A hair roller of the present invention may further comprise a temperature set point feature 23, as shown in FIG. 3B, that may give a general setting for temperature, such as low (L), medium (M), or high (H). In another embodiment, a temperature set point feature may provide for a specific temperature setting and may comprise a temperature read out display. A hair roller of the present invention may comprise a heat duration set point feature 24, as shown in FIG. 3B. A heat duration set point feature may allow a user to set how long they want the roller to be heated by the heating element. A hair roller of the present invention may comprise a sound feature 30, such as a speaker, as shown in FIG. 3B, that may be activated for any number of reasons as described herein. For example, a sound feature may be activated to produce a beeping sound when the heat duration time period has expired. A hair roller of the present invention may comprise a temperature sensor 36 such as a thermocouple that may be coupled to a roller controller 29, as shown in FIGS. 3A and 3B. In addition, a hair roller may comprise a repeat feature 70, as shown in FIG. 3A, whereby the heating cycle may be reset, or caused to repeat. A user may choose to use this feature if their hair needs more curling time. A repeat feature may be a button, switch or any other suitable user interface device.

A heating element 14, as shown in FIG. 4, may comprise a resistive element 40, that is heated by electrical current from the battery. A battery contact 43, may draw electrical current from the battery and connect to at least one resistive element. A resistive element 40 may comprise any suitable material and may be configured in any suitable manner. In an exemplary embodiment, a resistive wire 41 is configured around a heating element as shown in FIG. 4. In another exemplary embodiment, a resistive film 49 may be configured around a heating element as shown in FIG. 6. A resistive element may be configured within a hair capture portion, or may be configured on or within a hair roller capture portion. In one embodiment, a hair retainer, such as an attached clip or clips may be configured as a resistive element. For example, as shown in FIG. 3B, a plurality of hair retainers, such as clips 21, may be configured as resistive elements 40, and one or more clips may be used to secure hair to the hair roller while other clips may remain in a down position against the hair roller. A configuration of clips in direct contact with the hair may reduce the overall energy required to heat and fix a curl into hair.

As shown in FIG. 4 and FIG. 5, a heating element may be configured as a cylinder wherein a battery 13 may be disposed therein. A heating element may be a cylinder having an inner diameter 47, outer diameter 46 and wall thickness 48, as shown in FIG. 5. The heating element outer diameter 46 may be configured to nest within the inner diameter 27 of the hair capture portion. In addition, the inner diameter of a heating element 14 may be configured for insertion of a battery 13. The inner diameter of the resistive element may be configured to allow for the insertion of any suitable type of battery, including battery types D, C, A, AA, AAA, and the like.

Any number of features may be disposed on, or coupled to a hair roller, or the heating element 14, as shown in FIG. 5 including, but not limited to, a controller, a signal receiver, an on-off switch, a temperature set point feature, a heat duration feature, a sound feature and the like.

As shown in FIGS. 12A and 12B, a hair roller 12, may be configured with a heating element 14 that comprises heating fins 80 extending from the surface of the hair roller, or heating element body. The fins may be contiguous, such as spirally wound around the outside of the hair roller, as shown in FIG. 12A. Heating a fin may more effectively utilize power to heat the hair, as hair will be in direct contact with the surface of a fin. In addition, a fin provides a large surface area for contact with hair. Furthermore, the space between the fins, captures a small amount of hair that is heated by the fins on either side. A fin arrangement may more quickly transfer heat to hair and set a curl in hair and may require less energy.

As shown in FIG. 13A, hair roller 12 comprises four heating fins 80 that are configured as heating elements 14. The fins shown in FIG. 13A may be less prone to snag and/or tangle hair during use, as these fins have a rounded contour. The fins 80, shown in FIG. 13A may be connected electrically in a single resistive circuit, or they may be discrete heating elements, each having a discrete current therethrough. In one embodiment, only a portion of the fin is a resistive element, such as an outer layer of material, or a wire embedded therein. In another embodiment, essentially the entire fin is a resistive element and is heated.

An exemplary embodiment of the hair roller system 11 is shown in FIG. 7, having a hair roller 12 and a signal output device 16 configured on a controller 60. The controller 60 shown in FIG. 7 is a remote controller configured for hand held operation. The controller shown in FIG. 7 has a number of other features, including an on-off switch 62, a temperature set point feature 63, a heat duration feature 64, and a sound feature 66. The signal output feature may be activated by turning on the on-off switch 62, as shown in FIG. 7, or may have a separate user operative switch 67 that may send a signal when pressed, switched, or otherwise manipulated. The wireless signal may be any suitable type of signal, including radio waves for example. The heating element 14 on the hair roller 12 may turn on when the wireless signal 17, sent by the signal output device 16, is received by the signal receiver 15, as shown in FIG. 7. The signal output device may be configured in any suitable shape, and may be configured in a key fob type design and have one user operative feature to activate the sending of a wireless signal.

The hair roller system 11 of the present invention may comprise a roller container 90 in some embodiments, as shown in FIG. 8. A hair roller container may comprise spindles, protrusions, or recesses for holding and retaining rollers. A hair roller container may be configured with any number of hair roller retaining features including, but not limited to, more than one, more than two, more than five, more than ten, more than fifteen, more than twenty and any range between and including the quantities provided. A hair roller container may comprise a cover 95, as shown in FIG. 9. A hair roller container may be configured with a controller 60 having any number of features as described herein and shown in FIG. 8, including a signal output device 16. A repeat feature 70 may be configured on any suitable portion of the hair roller system, such as on a controller, as shown in FIG. 8.

A hair roller container may comprise a heating element 92 for preheating the rollers 12. The heating element may be configured to heat all the rollers within the container as shown in FIG. 11, or may be configured around individual rollers, as shown in FIG. 9. Furthermore, the hair roller container may be configured to supply power to a hair roller heating element. The hair roller container may comprise an electrical contact between the roller container power supply and a resistive element on a hair roller within the container. In an exemplary embodiment, only the hair rollers that are turned on, or activated, will be heated by the hair roller container power supply 96. Preheating the hair rollers while in a hair roller container and using the hair roller container power supply may provide for longer battery life of the hair roller battery. Furthermore, a user may only want to use a select number of rollers and may turn on a desired quantity for preheating by the roller container. Preheated rollers may only be heated to a temperature that is comfortable to touch, such as less than about 60° C., less than about 50° C., or less than about 40° C. These temperatures may not be hot enough to effectively set a curl in hair.

The hair roller container may comprise a battery 97 as shown in FIG. 9, or plug in power 98 as shown in FIG. 11. The battery 97, as shown in FIG. 9, may be any suitable type of battery or batteries, and may be rechargeable batteries. The hair roller system 11, may be portable, having battery power in a hair container. In one embodiment, the battery within the hair roller is a rechargeable battery and is re-charged by the roller container power supply.

As shown in FIGS. 14A and 14B, a separate hair capture clip 50 may be attached to a hair roller 12 to retain hair. The hair capture clip 50 shown in FIGS. 14A and 14B is configured to fit around a portion of the hair roller, and has a semi-circular shape. The separate hair capture clip, as shown, flexes open when pushed onto a hair roller 12. Any suitable type and configuration of a separate hair capture clip may be used, however. A separate hair capture clip 50 may be hinged as shown in FIG. 14C, and may be opened and closed by squeezing the levers 52. A person may open a separate hair capture clip, place it around a roller and then release the levers to attach the hair capture clip to the roller.

The hair roller system as described herein may comprise any shape and size of roller. For example, one roller may have a first size, including a first length and first diameter or width, and a second roller may have a second size, including a second length and second diameter or width that is different from the first roller size. Any number of different size rollers may be used.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalent.

Examples 1

Prophetic

A user places a plurality of hair rollers into their hair. Each hair roller comprises a heating element and a signal receiver. The user then activates a user operative switch to activate transmission of a wireless signal from a signal output device. The signal receivers on the plurality of hair rollers receive the wireless signal, and the heating elements within the plurality of rollers are activated to turn on.

The rollers heat up, and after a duration of time has elapsed the user again activates the user operative switch to activate transmission of a wireless signal from a signal output device. The signal receivers on the plurality of hair rollers receive the wireless signal, and the heating elements within the plurality of rollers are activated to turn off. The user then removes the rollers.

Examples 2

Prophetic

A user turns on a plurality of rollers that are located within a roller container. The user then turns on the roller container control unit which, in turn, begins preheating of rollers that were turned on. The user also sets a temperature set point to "high" and a heat duration time to twenty minutes. A sound feature emits a sound to indicate that the rollers are at a preheated temperature and are ready for placement in hair. The user then places the rollers in their hair. The user then manipulates a user operative switch that is located on the roller container controller to activate transmission of a wireless signal from a signal output device. The signal receivers on the plurality of hair rollers receives the wireless signal, and the heating elements within the plurality of rollers are activated to turn on. The wireless signal provides a wireless signal that provide temperature set point information. The hair rollers placed in the user hair then heats to an elevated temperature to the preheat temperature. The temperature is elevated to the heat set point temperature set by the user. After the heat duration time of twenty minutes has elapsed, a sound feature on the roller container alerts the user to remove the rollers. The roller container controller automatically transmits a wireless signal from a signal output device when the heat duration time has elapsed. The signal receivers on the plurality of hair rollers receive the wireless signal and the heating elements with the plurality of rollers are deactivated and turn off. The user may now safely remove the rollers.

What is claimed is:

1. An article comprising:

a. at least one hair roller comprising:

i. a battery;

ii. a heating element;

iii. a signal receiver;

iv. a roller controller for controlling at least one function of said hair roller;

b. a remote signal output device that produces a wireless signal, wherein said heating element is configured to be controlled by reception of a wireless signal from said remote signal output device by said signal receiver.

2. The article of claim 1, comprising at least ten rollers.

3. The article of claim 1, comprising a first roller having a first size and a second roller having a second size that is different from the said first size.

4. The article of claim 1, wherein the heating element is a detachable heating element, whereby the heating element may be detached from a hair capture portion.

5. The article of claim 1, wherein the heating element comprises a resistive wire.

6. The article of claim 1, wherein the heating element comprises a hair retainer that is a resistive element.

7. The article of claim 1, wherein the at least one roller further comprises an on/off switch.

8. The article of claim 1, further comprising a separate hair capture clip.

9. The article of claim 1, wherein the at east one roller further comprises a roller temperature set point feature.

10. The article of claim 1, wherein the at east one roller further comprises a roller heat duration set point feature.

11. The article of claim 1, wherein the said signal output device further comprises a temperature set point feature.

12. The article of claim 1, wherein the said signal output device further comprises a heat duration set point feature.

13. The article of claim 1, wherein the signal output device further comprises a sound feature.

14. The article of claim 1, further comprising a roller container.

15. The article of claim 14, wherein the remote signal output device is configured on the roller container.

16. The article of claim 14, wherein the roller container comprises a power supply and that is configured to heat rollers within the container.

17. The article of claim 14, wherein the roller container further comprises a power supply that comprises a battery.

18. The article of claim 14, wherein the roller container comprises a heating element.

19. The article of claim 16, wherein the roller container comprises a contact between the roller container power supply and the hair roller heating element.

* * * * *